US008177664B2

(12) United States Patent
Horii et al.

(10) Patent No.: US 8,177,664 B2
(45) Date of Patent: May 15, 2012

(54) PUTTER HEAD AND PUTTER HEAD SET

(75) Inventors: Daisuke Horii, Shinagawa-ku (JP); Takaharu Takechi, Shinagawa-ku (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 222 days.

(21) Appl. No.: 12/505,817

(22) Filed: Jul. 20, 2009

(65) Prior Publication Data

US 2010/0167836 A1 Jul. 1, 2010

(30) Foreign Application Priority Data

Dec. 25, 2008 (JP) ..... 2008-329702

(51) Int. Cl.
*A63B 53/04* (2006.01)
*A63B 53/06* (2006.01)

(52) U.S. Cl. ..... 473/340

(58) Field of Classification Search ..... 473/324–350
See application file for complete search history.

(56) References Cited

U.S. PATENT DOCUMENTS

| | | | | |
|---|---|---|---|---|
| 5,308,067 | A | 5/1994 | Cook | |
| 5,308,076 | A | 5/1994 | Sun | |
| 5,533,725 | A | 7/1996 | Reynolds, Jr. | |
| 5,688,189 | A * | 11/1997 | Bland | 473/314 |
| 6,203,443 | B1 * | 3/2001 | Britton | 473/244 |
| 6,485,375 | B1 * | 11/2002 | McKinley | 473/245 |
| 6,964,619 | B1 * | 11/2005 | Mejia | 473/286 |
| 7,326,121 | B2 | 2/2008 | Roake | |
| 7,407,443 | B2 * | 8/2008 | Franklin et al. | 473/251 |
| 7,491,131 | B2 * | 2/2009 | Vinton | 473/251 |
| 7,566,276 | B2 * | 7/2009 | Billings | 473/251 |
| 7,677,987 | B2 * | 3/2010 | Hilton | 473/242 |
| 7,828,675 | B2 * | 11/2010 | Hilton | 473/340 |
| 2007/0010348 | A1 * | 1/2007 | Jung | 473/340 |
| 2007/0293346 | A1 * | 12/2007 | Rollinson et al. | 473/340 |
| 2008/0207352 | A1 * | 8/2008 | Engel | 473/341 |
| 2009/0291772 | A1 * | 11/2009 | Boyd et al. | 473/291 |
| 2010/0234130 | A1 * | 9/2010 | Tavares et al. | 473/332 |
| 2010/0304886 | A1 * | 12/2010 | Boyd et al. | 473/334 |

FOREIGN PATENT DOCUMENTS

| | | | |
|---|---|---|---|
| JP | 11-114112 | A | 4/1999 |
| JP | 2001-224718 | A | 8/2001 |
| JP | 2002-224254 | A | 8/2002 |
| JP | 2005-66249 | A | 3/2005 |

* cited by examiner

*Primary Examiner* — Alvin Hunter
(74) *Attorney, Agent, or Firm* — Sughrue Mion, PLLC

(57) ABSTRACT

A putter head has the performance and characteristics of a putter, such as appearance, center of gravity, moment of inertia, ease of finding a putting line, and ease of setting, and can be adjusted by easily changing the shape of putter head by the golfer himself or herself, and a putter head set is also provided. A putter head includes a body member having a face surface for hitting a ball, and a back member detachably installed to the body member. The back member is detachably installed to the body member with one screw only.

14 Claims, 4 Drawing Sheets

PUTTER HEAD AND PUTTER HEAD SET

BACKGROUND OF THE INVENTION

The present invention relates to a putter head and to a putter head set.

In a golf game, final putting often decides the game, and not only the golfer's capability of putting but also the performance and characteristics of a putter are one of the factors in deciding the game. The performance and characteristics of a putter includes, for example, the center of gravity and moment of inertia of the putter head, ease of finding a putting line, and ease of setting. The adjustability of the performance and characteristics of a putter according to the physical condition of the golfer on the play day and the kind and condition of the green lawn is advantageous to the golfer.

However, in order to obtain the performance and characteristics of a putter, it is necessary to form the putter head into a specific shape using a specific material. Depending on the skill level and the adopted theory of the golfer, various performance and characteristics of the putter are required, and also, individual golfers like different appearances of putters. Therefore, putter heads having a wide variety of designs have been developed. However, there are few putter heads available for which the golfer can adjust the performance and characteristics of the putter.

For example, Japanese Patent Application Publication No. 2001-224718 describes a putter head formed by combining four parts to change the center of gravity of the putter head. The putter head is configured so that the four parts consist of a body, two wing parts located on both sides of the body, and a bottom part, and by fitting protrusions of the bottom part in grooves formed in the body and the wing parts, the parts are connected to each other. By forming the right and left wing parts by using materials having a different specific gravity, the center of gravity of the putter head can be changed to the right or the left.

In the configuration described in Japanese Patent Application Publication No. 2001-224718, however, although the center of gravity of putter head can be changed greatly by changing the specific gravity of the right and left wing parts of putter head, it is difficult to greatly change the moment of inertia of the putter head. Also, in the configuration described in Japanese Patent Application Publication No. 2001-224718, the number of parts constituting the putter head is large, and therefore it is not easy to assemble a putter head having a strength capable of withstanding putting by using these many parts.

Also, Japanese Patent Application Publication No. 2005-66249 describes a putter head provided with a front half body having a face surface and an arcuate rear half body attached to the rear side of the front half body. The front half body is formed of a metal having a small specific gravity, and the arcuate rear half body is formed of a metal having a large specific gravity. Therefore, the moment of inertia around the center of gravity of putter head is high, and the sweet area of putter head is large. However, Japanese Patent Application Publication No. 2005-66249 does not particularly describe that the moment of inertia of the putter head is adjusted. Also, in the configuration described in Japanese Patent Application Publication No. 2005-66249, the front half body and the rear half body are fixed with two bolts, so that this configuration is still insufficient for the golfer to himself or herself adjust the moment of inertia easily.

SUMMARY OF THE INVENTION

The present invention has been made to solve the above problems, and accordingly an object thereof is to provide a putter head such that the performance and characteristics of a putter, such as appearance, center of gravity, moment of inertia, ease of finding a putting line, and ease of setting, can be adjusted by easily changing the shape of putter head by the golfer himself or herself, and a putter head set.

To achieve the above object, in one aspect of the present invention, a putter head in accordance with the present invention includes a body member having a face surface for hitting a ball and a back member detachably installed to the body member, and is characterized in that the back member is detachably installed to the body member with one screw only.

Also, as another aspect of the present invention, a putter head set in accordance with the present invention includes a body member having a face surface for hitting a ball, and a plurality of back members exchangeably installed at the body member, and is characterized in that one of the plurality of back members is exchangeably installed at the body member with one screw only.

The body member preferably has a specific gravity less than that of the back member. Also, the body member preferably has a hardness lower than that of the back member. The putter head in accordance with the present invention preferably further includes a means for fixing the position of the back member with respect to the body member. It is preferable that the back member be fixed to the body member in the state in which the tip end part of the back member is pressed against the back part of the body member, and the tip end part be formed of a polymer material.

According to the present invention, since the back member is exchangeably installed to the body member with one screw only as described above, the golfer himself or herself can easily remove the back member of the putter head to change the shape of the putter head. Therefore, the performance and characteristics of a putter, such as appearance, center of gravity, moment of inertia, ease of finding a putting line, and ease of setting, can be adjusted.

DESCRIPTION OF THE PREFERRED EMBODIMENTS

Figure 1:
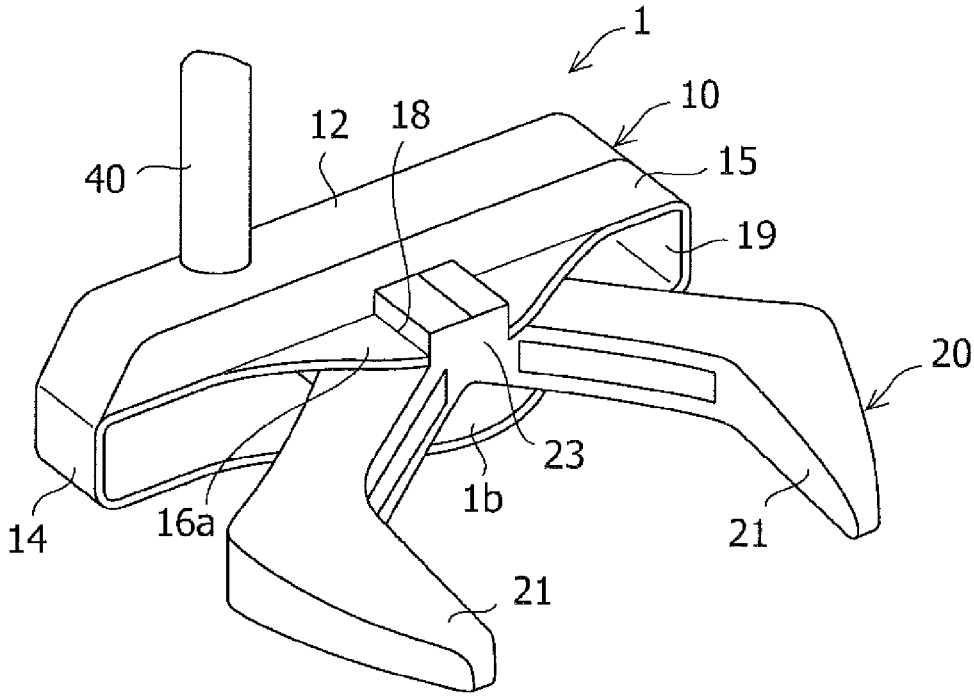
FIG. 1 is a perspective view showing one embodiment of a putter head in accordance with the present invention, viewed from obliquely above at the rear.
Figure 2:
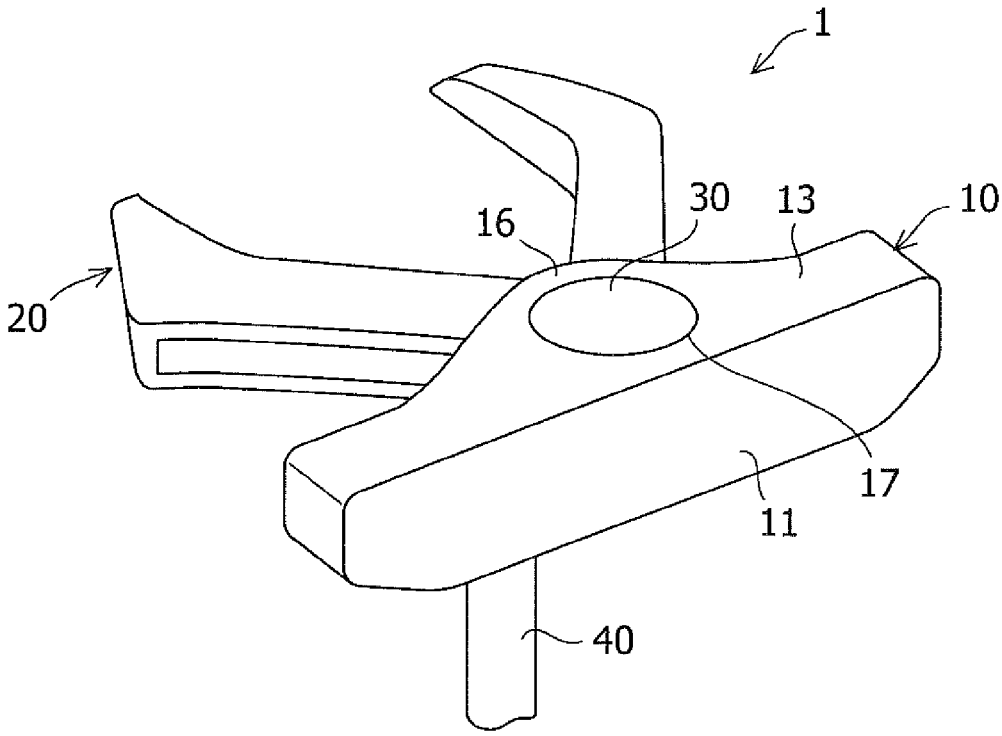
FIG. 2 is a perspective view of the putter head shown in FIG. 1, viewed from obliquely below at the front.
Figure 3:
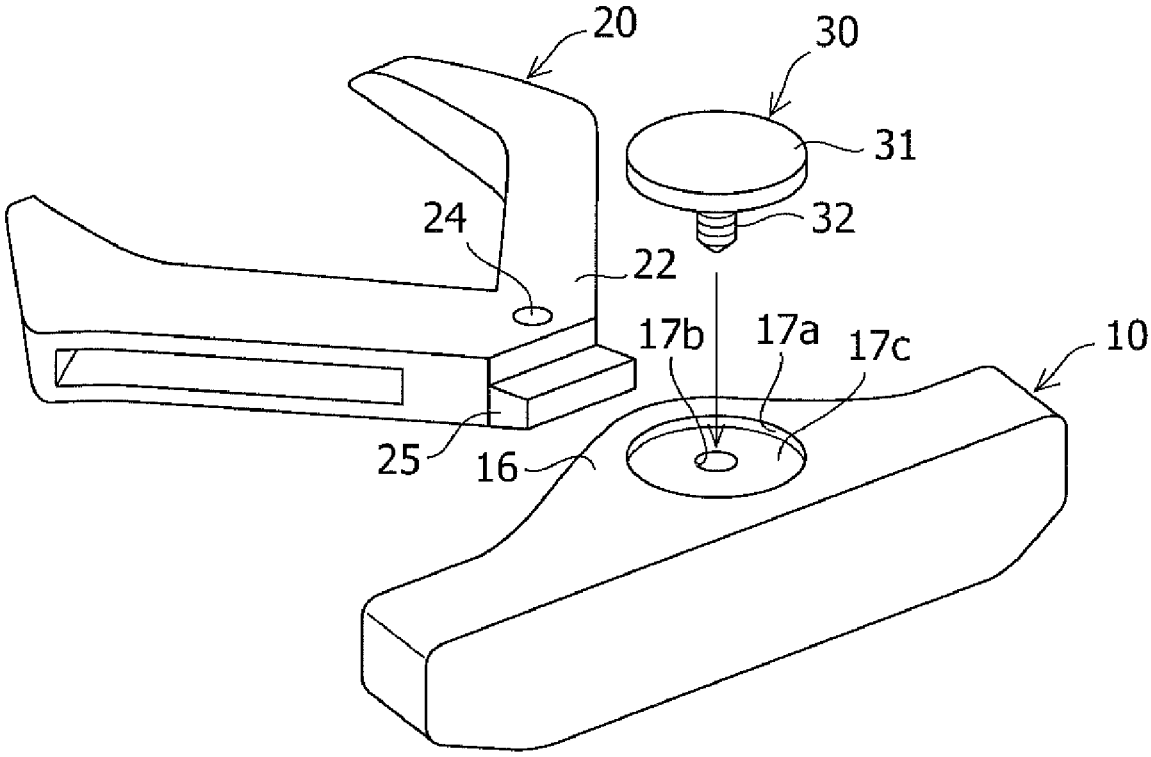
FIG. 3 is an exploded perspective view of the putter head shown in FIG. 1, viewed from obliquely below at the front.
Figure 4:
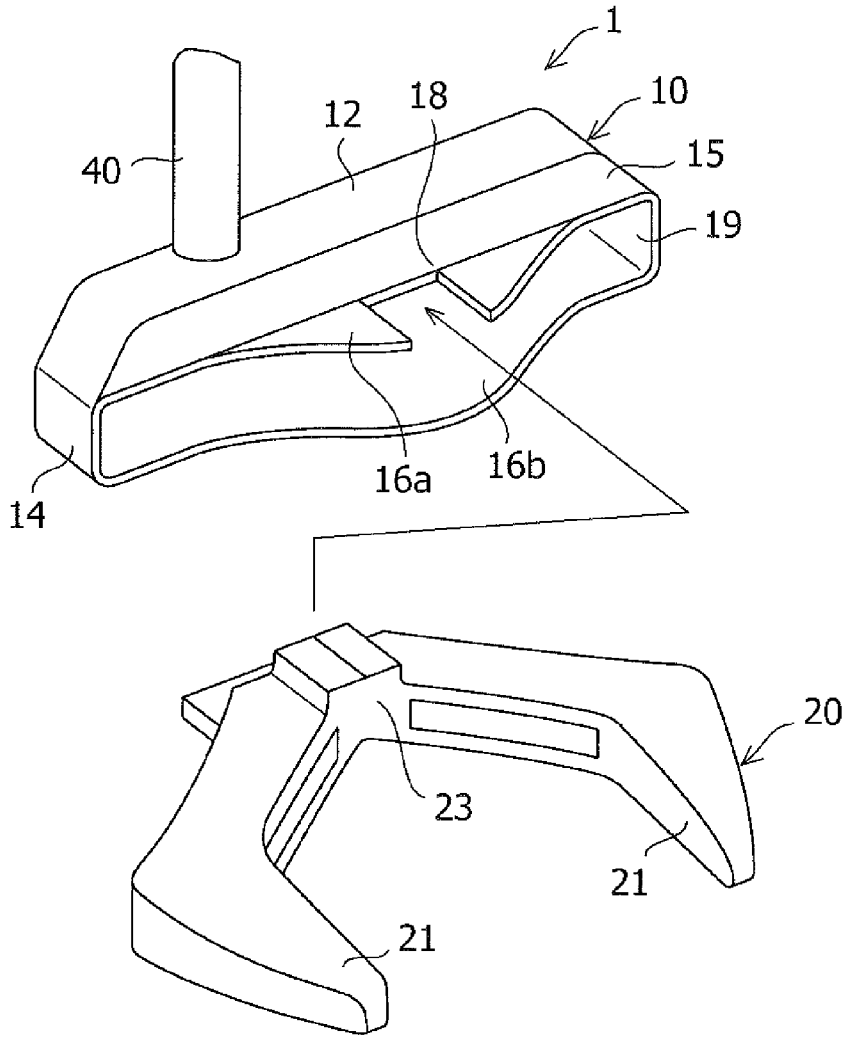
FIG. 4 is an exploded perspective view of the putter head shown in FIG. 1, viewed from obliquely above at the rear.

One embodiment of a putter head in accordance with the present invention will now be described with reference to the accompanying drawings. FIG. 1 is a perspective view showing one embodiment of the putter head in accordance with the present invention, viewed from obliquely above at the rear. FIG. 2 is a perspective view of the putter head shown in FIG. 1, viewed from obliquely below at the front. FIG. 3 is an exploded perspective view of the putter head shown in FIG. 2. FIG. 4 is an exploded perspective view of the putter head shown in FIG. 1.

As shown in FIGS. 1 to 4, a putter head 1 of this embodiment is composed mainly of a body member 10 having a face surface 11 for hitting a ball, a back member 20 detachably installed to the body member 10, one screw 30 for fixing the back member 20 to the body member 10, and a hosel 40 attached to the body member 10. The screw 30 includes a screw head part 31 and an external thread part 32.

The body member 10 includes, in addition to the face surface 11, a crown part 12, a sole part 13, side parts 14, and a back part 15. To the crown part 12 of the body member 10, the hosel 40 is fixed. The back part 15 of the body member 10 is provided with a pair of flaps 16 extending toward the rear of the putter head 1. The paired flaps 16 are preferably parallel with each other as shown in the figures. Also, the distance between the flaps 16 is made at least equal to the thickness of the back member 20.

A flap 16*a* on the crown side is provided with a positioning opening 18. As the shape of the positioning opening 18, a shape formed by cutting out the end part of the flap 16*a* as shown in FIG. 4 is preferable. The positioning opening 18 can be provided in plural numbers though only one positioning opening 18 is provided in the figures. A flap 16*b* on the sole side is provided with a screw fixing hole 17. The screw fixing hole 17 is preferably arranged in the center between the toe and the heel of the putter head 1. As the screw fixing hole 17, two holes of a large-diameter hole 17*a* for accommodating the screw head part 31 of the screw 30 and a small-diameter hole 17*b* for allowing the external thread part 32 to pass through are preferably provided. The depth of the large-diameter hole 17*a* is preferably greater than the height of the screw head part 31. The small-diameter hole 17*b* is provided in a hole bottom 17*c* of the large-diameter hole 17*a*.

As shown in the figures, the flap 16*b* on the sole side is preferably provided so as to extend in the same plane as the outer surface of the sole part 13. In this case, the screw fixing hole 17 may be provided ranging from the outer surface of the flap 16*b* on the sole side to the outer surface of the sole part 13. Also, the back part 15 of the body member 10 is preferably provided with a concavity 19 for accommodating the back member 20 between the crown-side flap 16*a* and the sole-side 16*b*.

As shown in the figures, the back member 20 is preferably provided with two extending parts 21 extending toward the rear of the putter head 1. These two extending parts 21 are provided in a fixing part 22 that is fixed to the body member 10. In the case in which the back member 20 is provided with two extending parts 21, the back member 20 can be formed substantially into a U shape or a Y shape in plan view as well as a V shape as shown in FIG. 3.

In order to increase the moment of inertia of the putter head to increase the sweet area, an angle formed between the two extending parts 21 is preferably large, being, for example, 80 degrees or greater, preferably 90 to 120 degrees. On the other hand, in order to decrease the moment of inertia of the putter head to make the hitting feeling sensitive, the angle formed between the two extending parts 21 is preferably small, being, for example, 30 degrees or smaller, preferably 0 degrees.

On the surface on the crown side of the fixing part 22 of the back member 20, a positioning protrusion 23 is provided. The protrusion 23 has a shape and size so as to fit the positioning opening 18 in the crown-side flap 16*a* of the body member 10. In the case in which the plurality of positioning openings 18 are provided, the protrusion 23 can be provided in plural numbers. In the surface on the sole side of the fixing part 22, a threaded hole 24, with which the external thread part 32 of the screw 30 is threadedly engaged, is provided.

In the fixing part 22 of the back member 20, a tip end part 25 formed of a polymer material is provided in the tip end portion on the body member 10 side of the fixing part 22. As shown in the FIG. 3, the tip end part 25 of the back member 20 preferably has a tapered shape. When the back member 20 is fixed to the body member 10 with the screw 30, the tip end part 25 of the back member 20 makes direct contact with the back part 15 of the body member 10.

The polymer material can be selected from synthetic resin, thermoplastic elastomer, and rubber. As the synthetic resin, for example, urethane resin can be used. As the thermoplastic elastomer, for example, urethane-based thermoplastic elastomer, polyamide-based thermoplastic elastomer, or polyester-based thermoplastic elastomer can be used. As the rubber, for example, styrene-butadiene rubber or butadiene rubber can be used.

The body member 10 preferably has a specific gravity less than that of the back member 20. By changing the shape of the back member 20 by decreasing the specific gravity of the body member 10 and increasing the specific gravity of the back member 20, the moment of inertia of the putter head 1 can be changed significantly. Also, the body member 10 preferably has a hardness less than that of the back member 20. By decreasing the hardness of the body member 10, the hitting feeling at the time when a ball is hit by the face surface can be made soft.

As a material that meets the above-described conditions, for example, aluminum, aluminum alloy, titanium, or titanium alloy can be used for the body member 10. As the aluminum alloy, AC4C (specific gravity: 2.7, Vickers hardness: about 200) or the like can be used. Also, for the back member 20, stainless steel, copper alloy, tungsten alloy, or the like can be used. As the stainless steel, SUS630 (specific gravity: 7.8, Vickers hardness: about 400) or the like can be used.

Although not shown in the figures, in the case in which a concavity is provided in the face surface 11 of the body member 10, and an insert formed of a polymer material is arranged in this concavity, too, the hitting feeling at the time when a ball is hit can be made soft. As the polymer material capable of being used for the insert, synthetic resin, thermoplastic elastomer, and the like are available.

The screw 30 is preferably made of a metal, further preferably made of the same material as that of the body member 10 or the back member 20. As the material for the screw 30, for example, aluminum, aluminum alloy, or stainless steel can be used. Although not shown in the figures, in the surface of the screw head part 31, a slot or a cross hole can be provided.

According to the above-described configuration, for the putter head 1, since the back member 20 is fixed to the body member 10 with one screw 30 only, the back member 20 can be removed easily from the body member 10 by loosening and removing the screw 30 as shown in FIG. 3.

When the back member 20 is to be installed to the body member 10, first, the fixing part 22 of the back member 20 is inserted between the paired flaps 16 provided in the back part 15 of the body member 10. At this time, the positioning protrusion 23 provided on the crown-side surface of the fixing part 22 of the back member 20 is inserted into the positioning opening 18 provided in the crown-side flap 16*a* of the body member 10. Also, the back member 20 is inserted into the body member 10 until the tip end part 25 of the back member 20 comes into contact with the back part 15 in the concavity 19 of the body member 10. At this time, the threaded hole 24 in the fixing part 22 of the back member 20 aligns with the screw fixing small-diameter hole 17*b* in the body member 10.

Next, the external thread part 32 of the screw 30 is caused to pass through the screw fixing small-diameter hole 17*b* in the body member 10. Then, the screw 30 is turned until the screw head part 31 of the screw 30 is locked to the hole bottom 17*c* of the screw fixing hole 17. Thereby, the external thread part 32 is threadedly engaged with the threaded hole 24 in the back member 20, whereby the back member 20 is fixed to the body member 10.

Although the back member 20 is fixed to the body member 10 with one screw 30 only, the two protrusions 23 provided on the crown-side surface of the fixing part 22 of the back member 20 fit in the two openings 18 provided in the crown-side flap 16*a* of the body member 10. Therefore, even if some load is applied to the back member 20, the back member 20 can be prevented from moving with respect to the body member 10. Also, since the back member 20 is fixed to the body member 10 in the state in which the tip end part 25, which is formed of a polymer material, of the back member 20 makes contact with the back part 15 of the body member 10, by the elasticity of the polymer material, a play can be prevented from occurring between the body member 10 and the back member 20.

Figure 5:
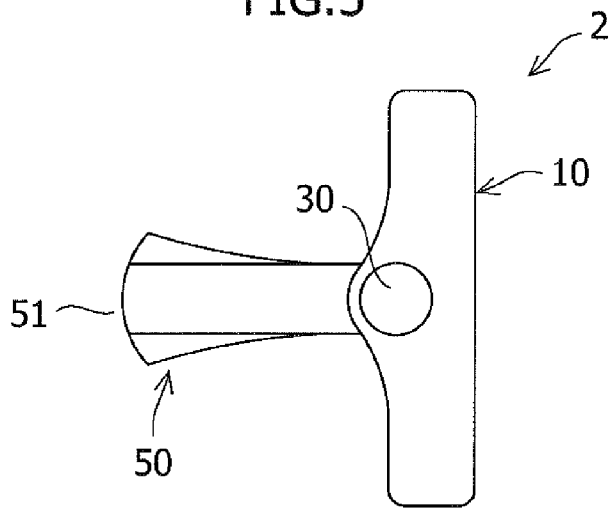
FIG. 5 is a bottom plan view showing another embodiment of a putter head in accordance with the present invention.

Since the back member 20 is fixed detachably, a back member having a shape different from that shown in FIGS. 1 to 4 can be installed. For example, a back member having a different angle between the two extending parts 21 can be installed, or a back member 50 having one extending part 51 as shown in FIG. 5 can also be installed. The back member having a smaller angle between two extending parts and the back member 50 having one substantially I-shaped extending part provide lower moment of inertia than the back member having a large angle between the extending parts. Therefore, the hitting feeling is sensitive, so that the rapid rolling feeling on the green can be controlled.

Figure 6:
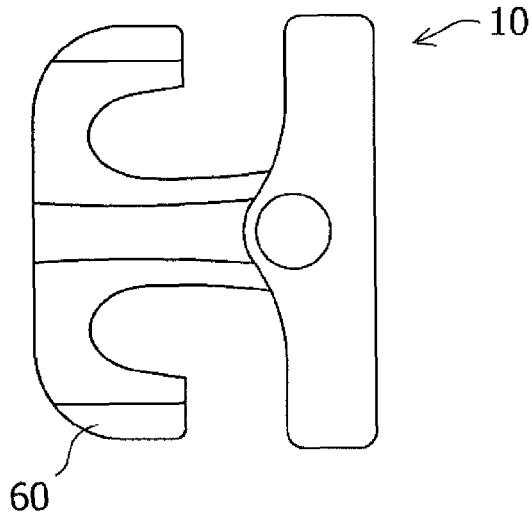
FIG. 6 is a bottom plan view showing still another embodiment of a putter head in accordance with the present invention.
Figure 7:
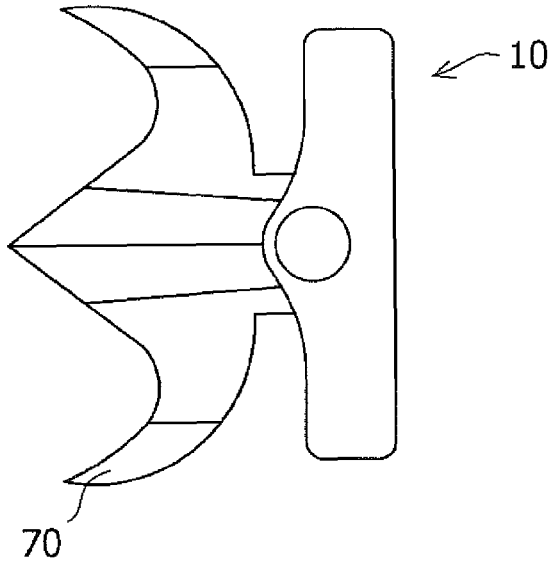
FIG. 7 is a bottom plan view showing still another embodiment of a putter head in accordance with the present invention.
Figure 8:
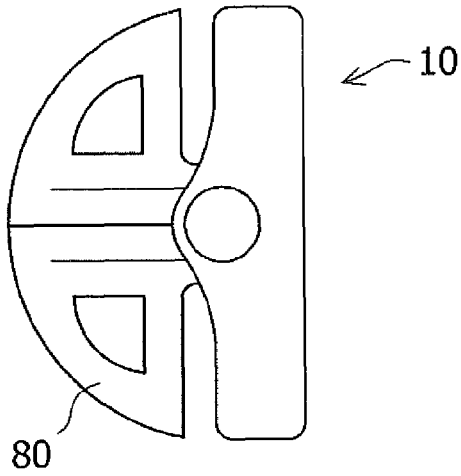
FIG. 8 is a bottom plan view showing still another embodiment of a putter head in accordance with the present invention.

Also, as shown in FIGS. 6 to 8, a back member 60 having substantially T-shaped extending parts, a back member 70 having three fork-shaped extending parts, or a back member 80 having a substantially semicircular extending part can also be installed. By making the extending parts substantially T-shaped or fork-shaped, both ease of finding a putting line and high moment of inertia can be attained. By making the extending part substantially semicircular, the putter head can be set easily by the same image as that of a mallet shape.

As described above, according to the present invention, the moment of inertia of the putter head 1 (around the axis passing through the center of gravity of putter head) can be changed by exchanging the back member 20 that is installed to the body member 10. In the case in which plural back members are prepared, the back members are preferably such that the weight of the putter head 1 is in the range of 300 to 400 g, and the moment of inertia around the center of gravity of the putter head 1 (the axis perpendicular to the horizontal plane is the reference) is in the range of 3000 to 7000 $g \cdot cm^2$. In particular, among the plurality of back members, each back member preferably has a difference in shape such that the moment of inertia around the center of gravity of the putter head 1 changes by 200 $g \cdot cm^2$ or greater, preferably 500 $g \cdot cm^2$ or greater.

What is claimed is:

1. A putter head comprising:

a body member having a face surface for hitting a ball, a crown part to which a hosel is fixed, a sole part, side parts, and a black part; and wherein the back part of the body member has a concavity for accommodating the back member, a tip end part of the back member making direct contact with the back part of the body member in the concavity, and the back member detachably installed to the body member, the back member being detachably installed to the body member with one screw only, wherein the body member has a sole-side flap extending in the same plane as an outer surface of the sole part, the sole-side flap and the back member being fixed with the screw, wherein the body member has a crown-side flap extending parallel with the sole-side flap, the crown-side flap having a positioning opening, and the back member having a positioning protrusion on a crown-side surface of the back member so as to fit the positioning opening.

2. The putter head according to claim 1, wherein the body member has a specific gravity less than that of the back member.

3. The putter head according to claim 1, wherein the body member has a hardness less than that of the back member.

4. The putter head according to claim 1, wherein the putter head further comprises a means for fixing the position of the back member with respect to the body member.

5. The putter head according to claim 1, wherein the back member is fixed to the body member in a state in which the tip end part of the back member is pressed against the back part of the body member, and the tip end part is formed of a polymer material.

6. The putter head according to claim 1, wherein the body member has a concavity on the face surface and has an insert arranged in the concavity.

7. The putter head according to claim 6, wherein the insert is made of thermoplastic elastomer.

8. A putter head set comprising:

a body member having a face surface for hitting a ball, a crown part to which a hosel is fixed, a sole part, side parts, and a back part; and a plurality of back members exchangeably installed to the body member, the plurality of back members having different shapes, wherein the back part of the body member has a concavity for accommodating one of the plurality of back members, a tip end part of one of the plurality of back members making direct contact with the back members, a tip end part of one of the plurality of back members making direct contact with the back part of the body member in the concavity, and wherein one of the plurality of back members is exchangeably installed to the body member with one screw only, wherein the body member has a sole-side flap extending in the same plane as an outer surface of the sole part, the sole-side flap and one of the plurality of back members being fixed with the screw, wherein the body member has a crown-side flap extending parallel with the sole-side flap, the crown-side flap having an positioning opening, and each of the plurality of back members having a positioning protrusion on a crown-side surface of the back member so as to fit the positioning opening.

9. The putter head set according to claim 8, wherein the body member has a specific gravity less than that of the plurality of back members.

10. The putter head set according to claim 5, wherein the body member has a Vickers hardness less than that of the plurality of back members.

11. The putter head set according to claim 5, wherein the putter head further comprises a means for fixing the position of the plurality of back members with respect to the body member.

12. The putter head set according to claim 5, wherein one of the plurality of back members is fixed to the body member in a state in which the tip end part of one of the plurality of back members is pressed against the back part of the body member, and the tip end part is formed of a polymer material.

13. The putter head set according to claim 8, wherein the body member has a concavity on the face surface and has an insert arranged in the concavity.

14. The putter head set according to claim 13, wherein the insert is made of thermoplastic elastomer.

* * * * *